United States Patent [19]

Fucík et al.

[11] Patent Number: 4,967,575

[45] Date of Patent: Nov. 6, 1990

[54] THREAD CUTTING AND HOLDING DEVICE

[75] Inventors: Borivoj Fucík, Markvartice; Pavel Zahrádka, Trebíc, both of Czechoslovakia

[73] Assignee: ELITEX koncern textilniho strojírenství, Liberec, Czechoslovakia

[21] Appl. No.: 254,321

[22] Filed: Oct. 5, 1988

[30] Foreign Application Priority Data

Oct. 6, 1987 [CS] Czechoslovakia ..... 7174-87

[51] Int. Cl.[5] ..... D04B 15/60

[52] U.S. Cl. ..... 66/14; 66/145 R

[58] Field of Search ..... 66/14, 134, 140 S, 140 R, 66/145 S, 145 R

[56] References Cited

U.S. PATENT DOCUMENTS

| | | | |
|---|---|---|---|
| 1,860,265 | 5/1932 | Page | 66/134 |
| 2,245,205 | 6/1941 | Lawson et al. | 66/134 |
| 2,252,214 | 8/1941 | St. Pierre | 66/134 |
| 2,940,285 | 6/1960 | Saunders | 66/140 R |
| 4,099,392 | 6/1978 | Lonati | 66/140 R |

*Primary Examiner*—Wm. Carter Reynolds

*Attorney, Agent, or Firm*—Klein & Vibber

[57] ABSTRACT

A thread cutting and holding device in double-cylinder circular knitting machine has a movable cutting plate, stationary cutting blade and pressing finger. Stationary and movable plates are arranged between the cutting plate and the pressing finger. Both movable plates are controlled by one lever. The stationary holding plate is arranged between the movable plates and is provided at its operative end with a V-shaped cutout, in which the threads are collected and held be the movable holding plate. The movable holding plate is for this reason provided with a side cutout with transverse holding edge.

5 Claims, 2 Drawing Sheets

THREAD CUTTING AND HOLDING DEVICE

FIELD OF THE INVENTION

The invention relates to a thread cutting and holding device in a double-cylinder circular knitting machine, which contains a movable cutting plate, stationary cutting blade and a pressing finger.

BACKGROUND OF THE INVENTION

Czechoslovak Author's Certificate No. 169,336 discloses a device to cut and hold non-operating thread ends. This device is provided with movable cutting plates which cooperate by their cutting edges with a cutting edge of a stationary blade and by their blunt edges with holding pressing fingers. Each cutting plate feeds the thread between the surface of the stationary blade at its holding edge and the pressing fingers. The shapes of the cutting edge and holding edge are similar and always approximately straight, so that the space between the edges or the surface is not curved. Thus, when holding a thread of a certain diameter the distance along the whole length of the holding space is the same. When holding two threads of different diameters this distance is given by the thicker thread and therefore the thinner thread is not sufficiently held.

U.S. Pat. No. 4,099,392 discloses a cutting and holding device where the cutting plate consists of two pieces, where one of them is moreover, in the cutout behind the cutting edge, provided with a projection designed to hold the thread. During operation of the device said projection holds the thread before the cutting edge and in fact it prolongs the free end of the thread. This actually prevents premature withdrawal of the held thread and holding is improved. However, this device does not solve the problem holding of two threads of different diameter.

SUMMARY OF THE INVENTION

Among the objects of the present invention are elimination of the above mentioned disadvantages and especially to improve the holding of threads having different diameters when plating and to provide a higher reliability of cutting.

These and other objects are achieved by providing a movable holding plate and a stationary holding plate between the movable cutting plate and the pressing finger.

An advantage of the present invention is that the new holding plates create another holding place which ensures pressing different threads together in a decreasing space and thus ensuring their reliable holding. Another advantage is that cutting and holding of the threads is within a certain scope independent of each other and thus the whole operation is more reliable.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENT

Figure 1:
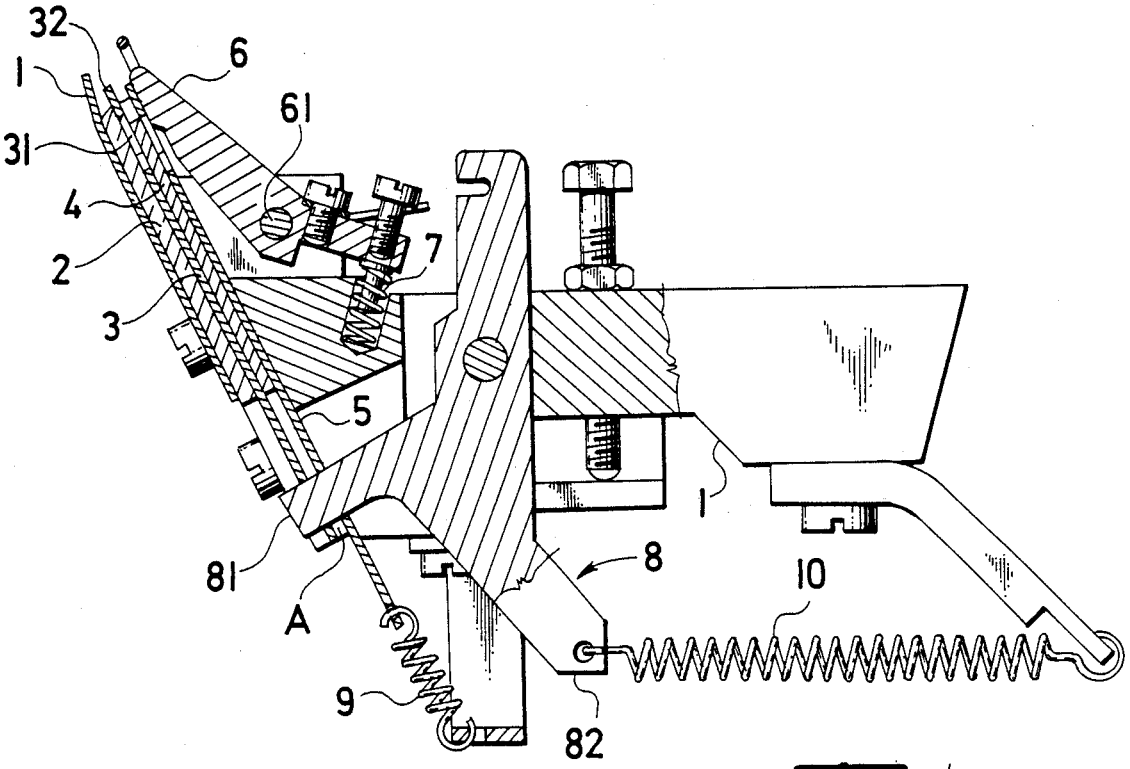
FIG. 1 is the cutting device in vertical section.

Referring to FIG. 1, the present invention is shown in a conventional surrounding. For example, a known double-cylinder circular knitting machine for the production of socks is, in each knitting feed, provided with a device to cut and hold the threads which cooperates with the device for controlling the thread guides. The device comprises a holder 1 in which there is fixed a stationary cutting blade 2. Above the stationary cutting blade 2 there are shiftably mounted cutting plates 3, each with a known cutout 31 to catch the thread and with a known transverse cutting edge 32. There is one shiftably mounted cutting plate 3 for each thread guide present.

Figure 3:
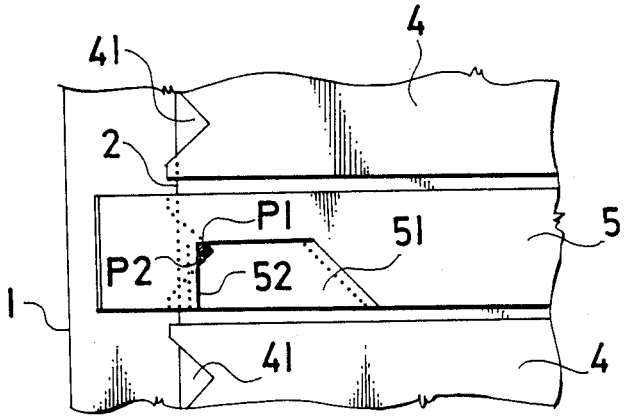
FIG. 3 is a top view illustrating holding the cut plating threads.
Figure 4:
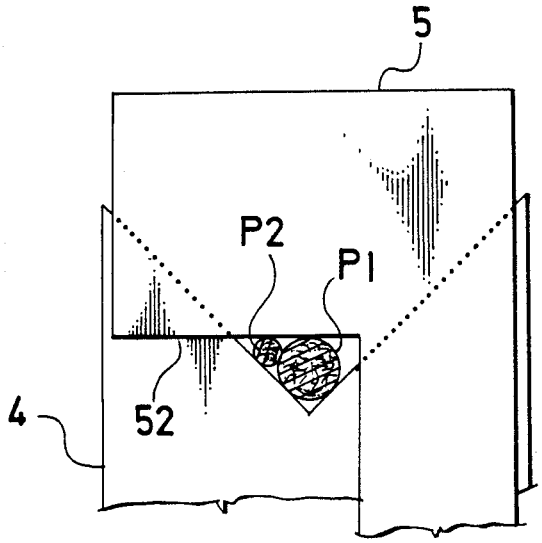
FIG. 4 is a detail of holding the plating threads.
Figure 5:
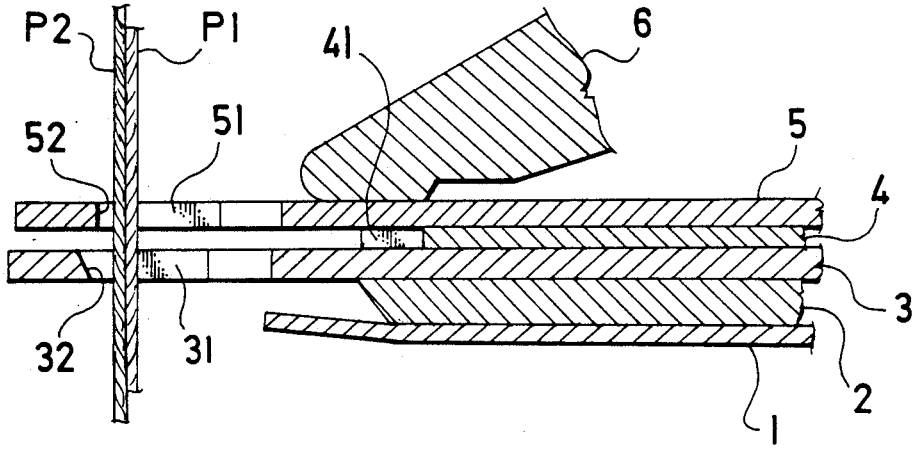
FIG. 5 is a view similar to FIG. 2, but showing the cutting and holding plates opened.

According to the present invention, above each cutting plate 3 there is a stationary holding plate 4 which is, in its front part, provided with a V-shape cutout 41 (see FIGS. 3 and 4). Above the stationary holding plate 4 there is a second shiftably mounted holding plate 5, the front side part of which is provided with a cutout 51 and with a holding edge 52 (see FIGS. 3–5).

A pressing finger 6, located swingably on a pin 61 of the holder 1, is assigned to movable holding plate 5. The pressing finger 6 is spring loaded by, e.g., a compression spring 7 located in a hole in the holder 1. Because the holding plate 4 is flexible it enables pressing of both said movable plates 3 and 5 towards the stationary cutting blade 2 due to the action of the compression spring 7.

Additionally, each cutting plate 3 and holding plate 5 are kinematically connected with a lever 8 which is controlled by a not shown transmission by a stripping device. The arm 81 of the lever 8 is, without a clearance, connected with the cutting plate 3, and with the holding plate 5 with a certain clearance indicated by the letter A. Holding plate 5 is pressed to the arm 81 of the lever 8 by a tension spring 9 which is connected on the one hand to the plate 5 and on the other hand to the holder 1. Lever 8 is further spring loaded by, e.g., a tension spring 10 connected to its arm 82 and further to a part of the holder 1.

MANNER OF OPERATION

The operation of the above described device is as follows: Lever 8 is swung clockwise by a not shown transmission and lifts by its arm 81 the cutting plate 3 and holding plate 5 against the tension of the springs 9 and 10. A not shown plating guide feeds the threads P1, P2 (see FIG. 5) in a conventional manner into the cutouts 31 and 51 in said shifted plates 3 and 5.

After another command from the transmission, the lever 8 begins to return to its original position and together with it also the cutting plate 3 and holding plate 5. Threads P1 and P2 are first drawn between the holding plate 5 and the pressing finger 6.

Figure 2:
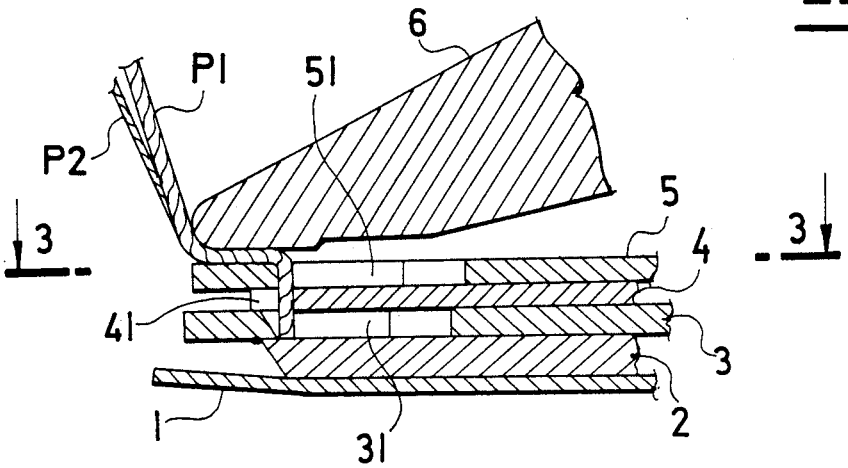
FIG. 2 is a detail of holding the thread by the plates and the pressing finger.

During further motion, the threads P1, P2 are cut between the cutting plate 3 and stationary cutting blade 2, as illustrated in FIG. 2.

During further motion, the holding edge 52 of the holding plate 5 collects both threads P1, P2 in the tip of the cutout 41 in the holding plate 4, as evident best from FIG. 4 and holding the threads P1 and P2 stops the movement of the holding plate 5. Said stopping of the movement is enabled by the clearance A in the mount of the arm 81 of the lever 8 in the holding plate 4. Both threads P1, P2 are held here by the spring 9.

Cutting plate 3 still continues its motion within the already mentioned clearance A and stops together with the lever 8. Threads P1 and P2 are then held in the point of the V-shaped cutout 41 in the holding plate 4 (see FIGS. 3 and 4). Here both threads P1 and P2 come in mutual contact, even when their diameters are different, and in contact with both holding plates 4 and 5 which is due to the shape of the cutout 41 in the stationary holding plate 4.

Although the invention is described and illustrated with reference to a single embodiment thereof, it is to be expressly understood that it is in no way limited to the disclosure of such preferred embodiment but is capable of numerous modifications within the scope of the appended claims.

What we claim is:

1. A thread cutting and holding device in a double-cylinder circular knitting machine having a movable cutting plate, stationary cutting blade and a pressing finger, said device comprising a movable holding plate and a stationary holding plate arranged between the movable cutting plate and pressing finger;

the movable cutting plate and movable holding plate being kinematically connected by only one control lever, a clearance being provided between the control lever and the movable holding plate and a tension spring connected to an end of the movable holding plate.

2. A device as claimed in claim 1, further comprising the stationary holding plate being arranged between the movable holding plate and movable cutting plate.

3. A thread cutting and holding device in a double-cylinder circular knitting machine having a movable cutting plate, stationary cutting blade and a pressing finger, said device comprising a movable holding plate and a stationary holding plate arranged between the movable cutting plate and pressing finger;

a front end of the stationary holding plate being provided with a V-shaped cutout; and a side of the movable holding plate being provided with a side cutout with a transverse thread holding edge for cooperation with the V-shaped cutout of the stationary holding plate.

4. A device as claimed in claim 3, further comprising the movable cutting plate and the movable holding plate being mutually kinematically connected.

5. A device as claimed in claim 3, further comprising the stationary holding plate being arranged between the movable holding plate and movable cutting plate.

* * * * *